US006527047B1

(12) United States Patent
Pietras

(10) Patent No.: US 6,527,047 B1
(45) Date of Patent: Mar. 4, 2003

(54) METHOD AND APPARATUS FOR CONNECTING TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/762,698

(22) PCT Filed: Aug. 16, 1999

(86) PCT No.: PCT/GB99/02704

§ 371 (c)(1),
(2), (4) Date: May 10, 2001

(87) PCT Pub. No.: WO00/11309

PCT Pub. Date: Mar. 2, 2000

(30) Foreign Application Priority Data

Aug. 24, 1998 (GB) ..... 9818366

(51) Int. Cl.[7] ..... E21B 19/06
(52) U.S. Cl. ..... 166/77.51; 166/77.52
(58) Field of Search ..... 175/52, 85, 161, 175/202, 203; 166/77.51, 85, 66.53, 77.52

(56) References Cited

U.S. PATENT DOCUMENTS

| | | | | |
|---|---|---|---|---|
| 3,193,116 A | | 7/1965 | Kenneday et al. | |
| 3,635,105 A | | 1/1972 | Dickmann et al. | |
| 3,747,675 A | | 7/1973 | Brown | |
| 3,766,991 A | | 10/1973 | Brown | 173/20 |
| 3,776,320 A | | 12/1973 | Brown | |
| 3,857,450 A | | 12/1974 | Guier | 175/85 |
| 3,913,687 A | | 10/1975 | Gyongyosi et al. | 175/85 |
| 4,437,363 A | | 3/1984 | Haynes | |
| 4,449,596 A | | 5/1984 | Boyadjieff | 175/85 |
| 4,494,424 A | | 1/1985 | Bates | |
| 4,529,045 A | * | 7/1985 | Boyadjieff et al. | 173/164 |

(List continued on next page.)

FOREIGN PATENT DOCUMENTS

| | | | |
|---|---|---|---|
| EP | 0 171 144 A1 | 2/1986 | E21B/19/06 |
| EP | 0 285 386 | 10/1988 | |
| EP | 0 659 975 | 6/1995 | E21B/43/08 |
| WO | WO 96/18799 | 6/1996 | |
| WO | 97/17524 | 5/1997 | E21B/43/08 |
| WO | WO 98/11322 | 3/1998 | |
| WO | 98/22690 | 5/1998 | E21B/17/08 |
| WO | 98/32948 | 7/1998 | E21B/19/16 |

OTHER PUBLICATIONS

USSN patent application, Ser. No. 09/550,721, filed: Apr. 17, 2000, "Top Drive Casing System," Snider, et al.

Pietras, Bernd–Georg, "An Apparatus For Facilitating The Connection of Tubulars Using A Top Drive," Patent Form 1/77, Request for grant of patent dated Jul. 16, 1998. (417B–UK).

(List continued on next page.)

*Primary Examiner*—Frank S. Tsay
(74) *Attorney, Agent, or Firm*—Moser, Patterson & Sheridan, L.L.P.

(57) ABSTRACT

An apparatus for facilitating the connection of tubulars, said apparatus comprising a winch (15), at least one wire line (4, 5) and a device (2) for gripping a tubular (3), the arrangement being such that, in use, the winch (15) can be used to winch said at least one wire (4, 5) and said device (2) to position a tubular (3) below said top drive.

18 Claims, 9 Drawing Sheets

U.S. PATENT DOCUMENTS

Figure 1A:
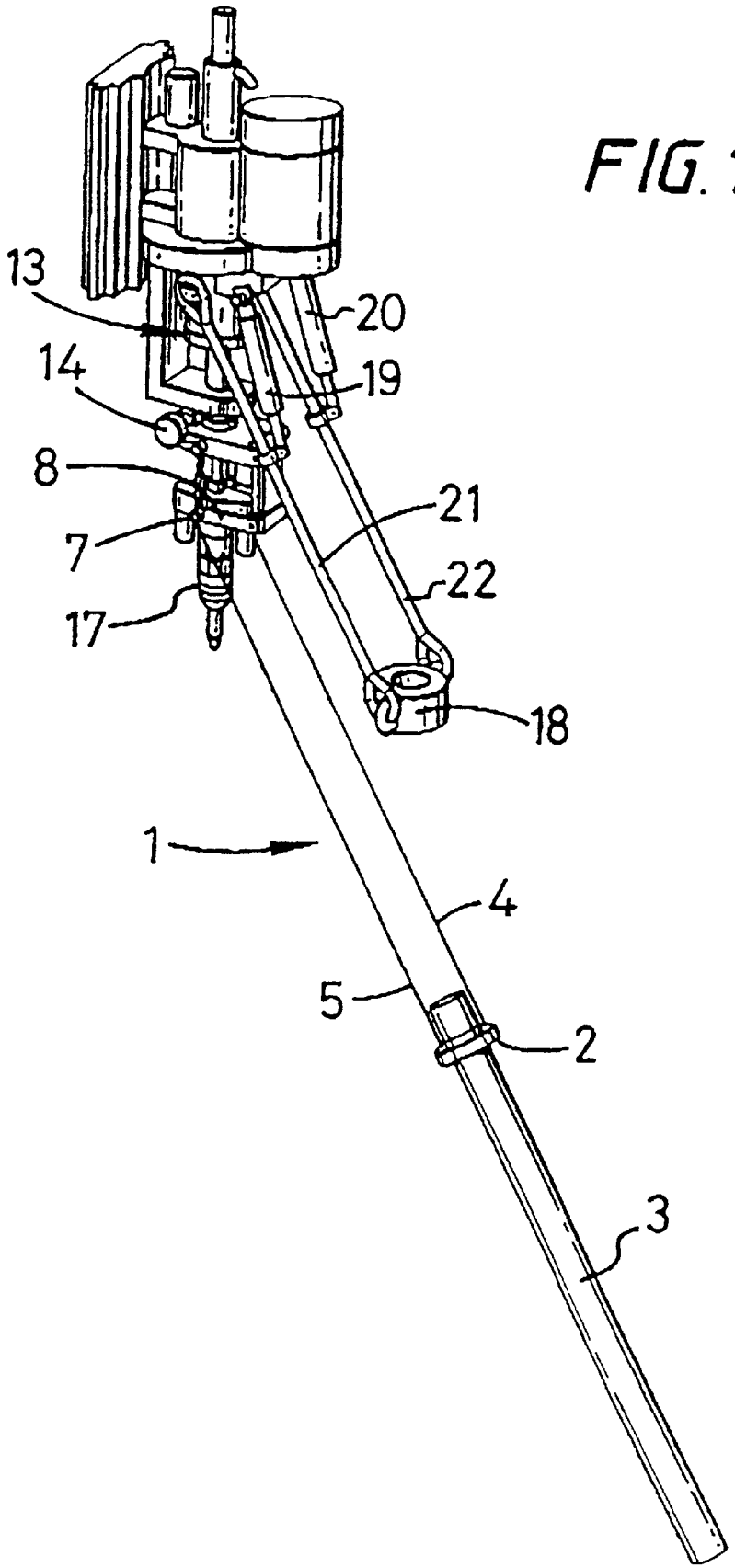

| | | | | | |
|---|---|---|---|---|---|
| 4,570,706 | A | | 2/1986 | Pugnet | |
| 4,625,796 | A | | 12/1986 | Boyadjieff | 166/77.5 |
| 4,649,777 | A | | 3/1987 | Buck | |
| 4,709,599 | A | | 12/1987 | Buck | |
| 4,754,807 | A | | 7/1988 | Lange | 166/236 |
| 4,759,239 | A | | 7/1988 | Hamilton et al. | |
| 4,791,997 | A | * | 12/1988 | Krasnov | 175/57 |
| 4,793,422 | A | | 12/1988 | Krasnov | 175/57 |
| 4,800,968 | A | * | 1/1989 | Shaw et al. | 175/85 |
| 4,813,493 | A | | 3/1989 | Shaw et al. | 173/164 |
| 4,836,064 | A | | 6/1989 | Slator | |
| 4,867,236 | A | | 9/1989 | Haney et al. | |
| 4,878,546 | A | | 11/1989 | Shaw et al. | 173/163 |
| 5,251,709 | A | | 10/1993 | Richardson | 175/220 |
| 5,282,653 | A | | 2/1994 | LaFleur et al. | |
| 5,297,833 | A | | 3/1994 | Willis et al. | |
| 5,351,767 | A | * | 10/1994 | Stogner et al. | 175/162 |
| 5,388,651 | A | | 2/1995 | Berry | 175/85 |
| 5,503,234 | A | * | 4/1996 | Clanton | 175/52 |
| 5,577,566 | A | | 11/1996 | Albright et al. | |
| 5,645,131 | A | | 7/1997 | Trevisani | |
| 5,836,395 | A | | 11/1998 | Budde | |
| 6,000,472 | A | | 12/1999 | Albright et al. | |
| 6,070,500 | A | | 6/2000 | Dlask et al. | |
| 6,199,641 | B1 | | 3/2001 | Downie et al. | |
| 6,309,002 | B1 | * | 10/2001 | Bouligny | 294/86.25 |
| 6,311,792 | B1 | | 11/2001 | Scott et al. | |
| 6,349,764 | B1 | * | 2/2002 | Adams et al. | 166/77.53 |

OTHER PUBLICATIONS

Pietras, Bernd–Georg, "An Apparatus For Facilitating The Connection of Tubulars Using A Top Drive," Patent Form 1/77, Request for grant of patent dated Jul. 16, 1998. (417C–UK).

Pietras, Bernd–Georg, "An Apparatus For Facilitating The Connection of Tubulars Using A Top Drive," Patent Form 1/77, Request for grant of patent dated Jul. 16, 1998. (417D–UK).

Pietras, Bernd–Georg, "An Apparatus For Facilitating The Connection of Tubulars Using A Top Drive," Patent Form 1/77, Request for grant of patent dated Jul. 16, 1998. (417A–UK).

LaFleur Petroleum Services, Inc., "Autoseal Circulating Head," Engineering Manufacturing, 1992, 11 Pages.

Valves Wellhead Equipment Safety Systems, W–K–M Division, ACF Industries, Catalog 80, 1980, 5 Pages.

"Canrig Top Drive Drilling Systems," Hart's Petroleum Engineer International, Feb. 1997, 2 Pages.

"The Original Portable Top Drive Drilling System," TESCO Drilling Technology, 1997.

Killalea, Mike. "Portable top drives: What's driving the market?" IADC, Drilling Contractor, Sep. 1994, 4 Pages.

"500 or 650 ECIS Top Drive," Advanced Permanent Magnet Motor Technology, TESCO Drilling Technology, Apr. 1998, 2 Pages.

"500 or 650 HCIS Top Drive," Powerful Hydraulic Compact Top Drive Drilling System, TESCO Drilling Technology, Apr. 1998, 2 pages.

"Product Information (Sections 1–10)," CANRIG Drilling Technology, Ltd., Sep. 18, 1996,.

USSN patent application, Ser. No.: 08/755,128, filed: Nov. 22, 1996, "Circulating Head," Giroux, et al.

* cited by examiner 15
14
11
17
9
5
4
2
3

13
20
19
15
14
12
11
9
6
7
8
10
2
16
21
22
3
18

METHOD AND APPARATUS FOR CONNECTING TUBULARS USING A TOP DRIVE

This invention relates to a method and apparatus for facilitating the connection of tubulars using a top drive and is, more particularly but not exclusively, for facilitating the connection of a section or stand of casing to a string or casing.

In the construction of wells such as oil or gas wells, it is usually necessary to line predrilled holes with a string of tubulars known as casing. Because of the size of the casing required, sections or stands of say two sections of casing are connected to each other as they are lowered into the well from a platform. The first section or stand of casing is lowered into the well and is usually restrained from falling into the well by a spider located in the platform's floor. Subsequent sections or stands of casing are moved from a rack to the well centre above the spider. The threaded pin of the section or stand of casing to be connected is located over the threaded box of the casing in the well to form a string of casing. The connection is made-up by rotation therebetween.

It is common practice to use a power tong to torque the connection up to a predetermined torque in order to perfect the connection. The power tong is located on the platform, either on rails, or hung from a derrick on a chain. However, it has recently been proposed to use a top drive for making such connection.

Prior to the present invention, pipe handling devices moved pipes to be connected to a tubular string from a rack to the well centre using articulated arms or, more commonly, a pipe elevator suspended from the drilling tower.

The present invention provides an alternative to these devices.

Accordingly, a first aspect of the present invention provides an apparatus for facilitating the connection of tubulars, said apparatus comprising a winch, at least one wire line and a device for gripping a tubular the arrangement being such that, in use, the winch can be used to winch said at least one wire and said device to position a tubular below said top drive.

Further features are set out in claims 2 to 6.

According to a second aspect of the present invention there is provided a method of facilitating the connection of tubulars using a top drive and comprising the steps of attaching at least one wire to a tubular, the wire depending from the top drive or from a component attached thereto, and winching the wire and the tubular upwards to a position beneath the top drive.

According to a third aspect of the present invention there is provided an apparatus for facilitating, the connection of tubulars using a top drive, said apparatus comprising an elevator and a pair of bails, characterised in that said elevator is, in use, movable in relation to said pair of bails.

According to a fourth aspect of the present invention there is provided an apparatus for facilitating the connection of tubulars using a top drive, said apparatus comprising, an elevator (102) and a pair of bails (103, 104), characterised in that said elevator (102) is, in use, movable relative to said pair of bails (103, 104).

For a better understanding of the present invention and in order to show how the same may be carried into effect reference will now be made, by way of example, to the accompanying drawings in which:

FIGS. 1*a* to 1*e* are perspective views of an apparatus in accordance with a first embodiment of the present invention at various stages of operation; and FIGS. 2*a* to 2*d* are perspective views of an apparatus in accordance with a second embodiment of the invention at various stages of operation.

Referring to FIGS. 1*a* to 1*e* there is shown an apparatus which is generally identified by reference numeral 1.

The apparatus 1 comprises a clamp 2 for retaining a tubular 3. The clamp 2 is suspended on wires 4, 5 which are connected thereto on opposing sides thereof. The wire 5 passes through an eye 6 in lug 7 which is attached to a spherical bearing in arm 8 of a suspension unit 9 at the point at which the arm 8 is connected to a hydraulic motor 10. The wire is connected to the hydraulic motor 10 in a corresponding manner. The suspension unit 9 is of a type which enables displacement of the tubular 3 when connected to a tool 17 (see below), relative to a top drive 13, along a number of different axes. The wires 4, 5 pass across the suspension unit 9 and over pulley wheels 11 which are rotatably arranged on a plate 12. The plate 12 is fixed in-relation to a top drive generally identified by reference numeral 13. The wires 4, 5 then pass over drums 14 to which the wires 4, 5 are also connected. The drums 14 are rotatable via a hydraulic winch motor 15.

Figure 1B:
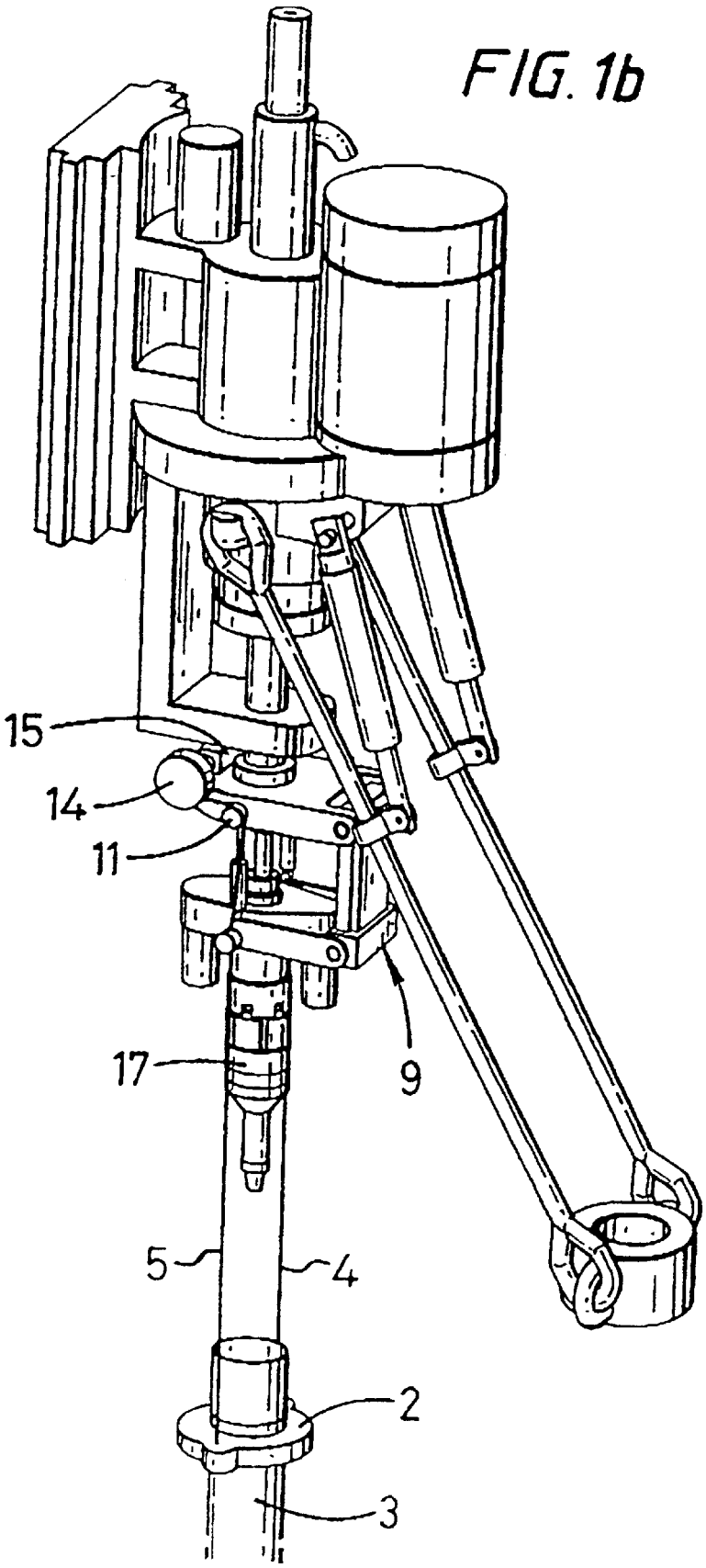
Figure 1C:
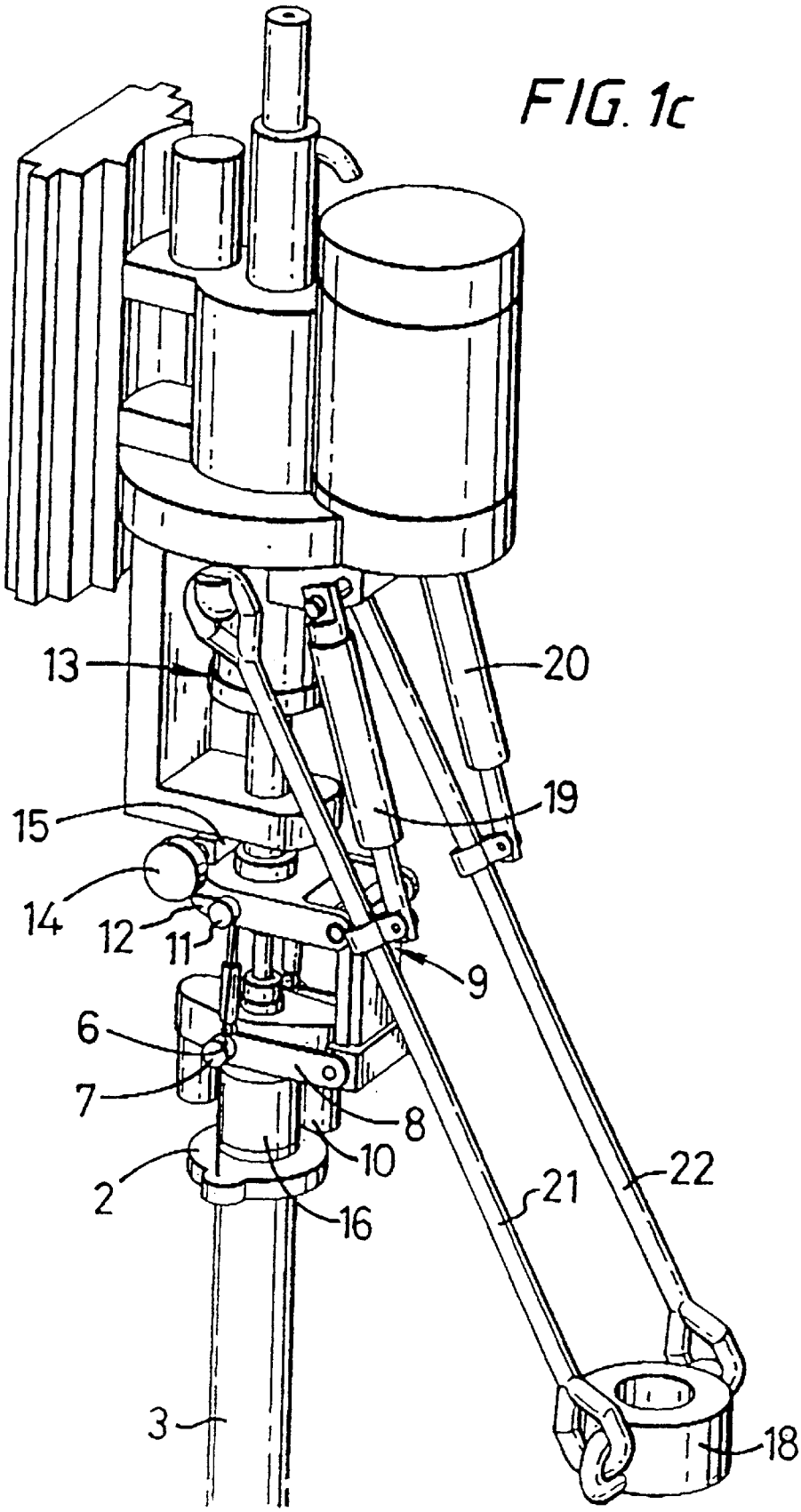

In use, the clamp 2 is placed around a tubular below a box 16 thereof The hydraulic winch motor 15 is then activated, which lifts the tubular 3 (conveniently from a rack) and towards a tool 17 for gripping the tubular 3 (FIG. 1*b*). The tubular 3 encompasses the tool 17 at which point the hydraulic winch motor 15 is deactivated FIG. 1*c*). During this operation the elevator 18 is held away from the tool 17 by piston and cylinders 19, 20 acting on bails 21 and 22. The suspension unit 9 allows the hydraulic motor 10 and the arrangement depending therebelow to move in vertical and horizontal planes relative to the top drive 13. The eyes 6 in lugs 7 maintain the wires 4 and 5 in line with the tubular 3 during any such movement. The tool 17 may now be used to connect the tubular to the tubular string. More particularly, the tool may be of a type which is inserted into the upper end of the tubular, with gripping elements of the tool being radially displaceable for engagement with the inner wall of the tubular so as to secure the tubular to the tool. Once the tool is secured to the tubular, the hydraulic motor 10 is activated which rotates the tool 17 and hence the tubular 3 for engagement with a tubular string held in a spider.

Figure 1D:
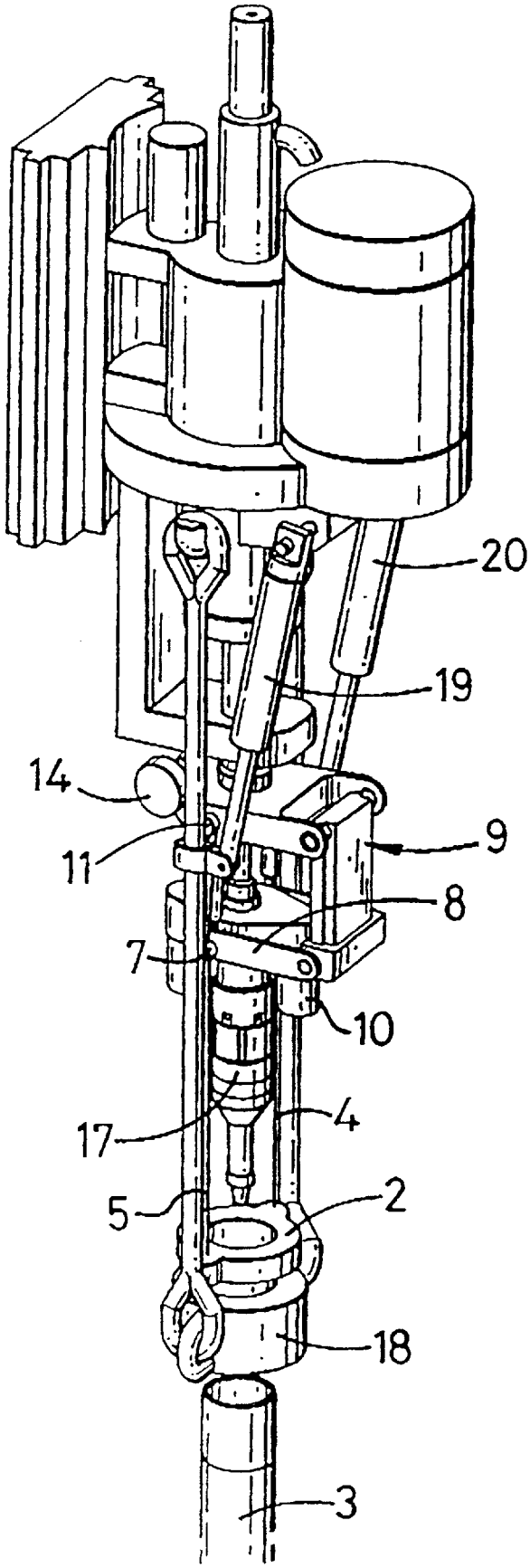
Figure 1E:
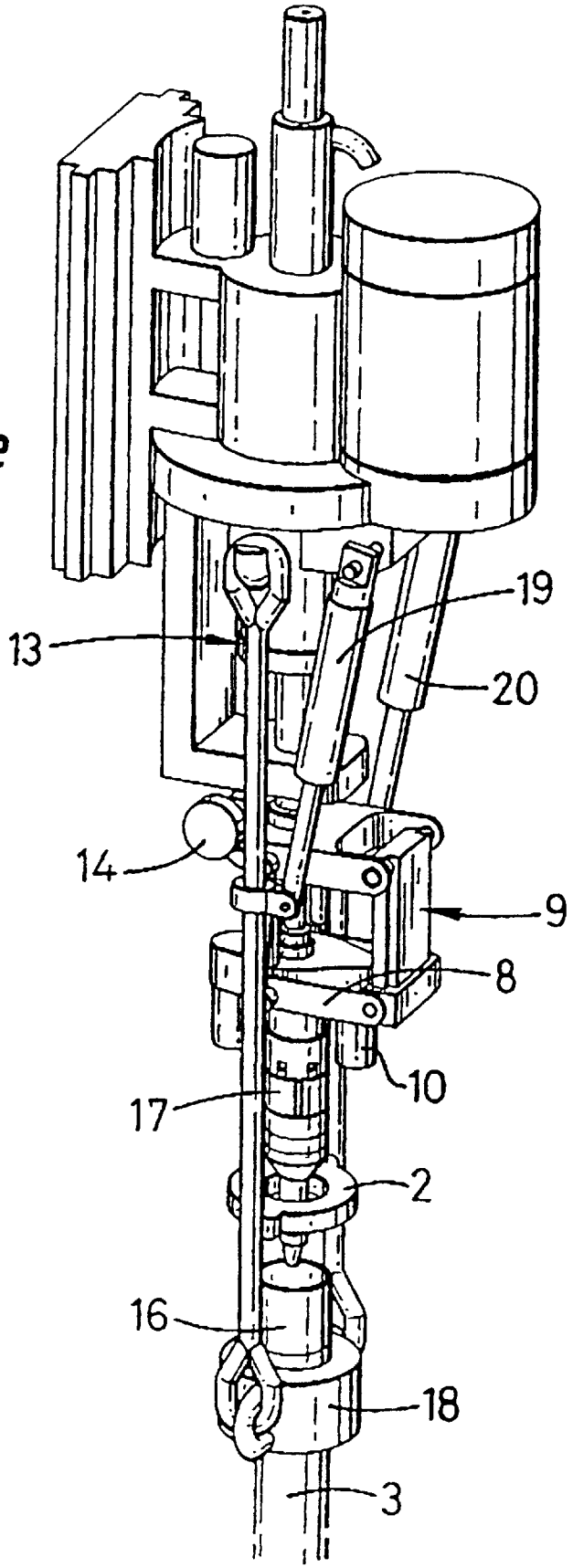

The clamp 2 is now released from the tubular 3, and the top drive 13 and hence apparatus 1 is now lifted clear of the tubular 3. The elevator 18 is now swung in line with the apparatus 1 by actuation of the piston and cylinders 19 and 20 (FIG. 1*d*).

The top drive 13 is then lowered, lowering the elevator 18 over the box 16 of the tubular 3. The slips in the elevator 18 are then set to take the weight of the entire tubular string. The top drive is then raised slightly to enable the slips in the spider to be released and the top drive is then lowered to introduce the tubular string into the borehole.

Referring to FIGS. 2*a* to 2*d* there is shown an apparatus which is generally identified by reference numeral 101.

The apparatus 101 comprises an elevator 102 arranged at one end of bails 103, 104. The bails 103, 104 are movably attached to a top drive 105 via axles 106 which are located in eyes 107 in the other end of the bails 103, 104. Piston and cylinders 108, 109 are arranged between the top drive 105 and the bails. One end of the piston and cylinders 108, 109 are movably arranged on axles 110 on the top drive. The other end of the piston and cylinders 108, 109 are movably arranged on axles 111, 112 which are located in lugs 113, 114 located approximately one-third along the length of the bails 103, 109.

The elevator 102 is provided with pins 115 on either side thereof and projecting therefrom. The pins 115 are located in slots 116 and 116*a*. A piston 117, 118 and cylinder 119, 120 are arranged in each of the bails 103, 104. The cylinders are arranged in slot 121, 122. The piston 117, 118 are connected at their ends to the pins 115. The cylinders 119, 120 are prevented from moving along the bails 103, 104 by cross members 123 and 124. A hole is provided in each of the cross members to allow the pistons to move therethrough.

Figure 2A:
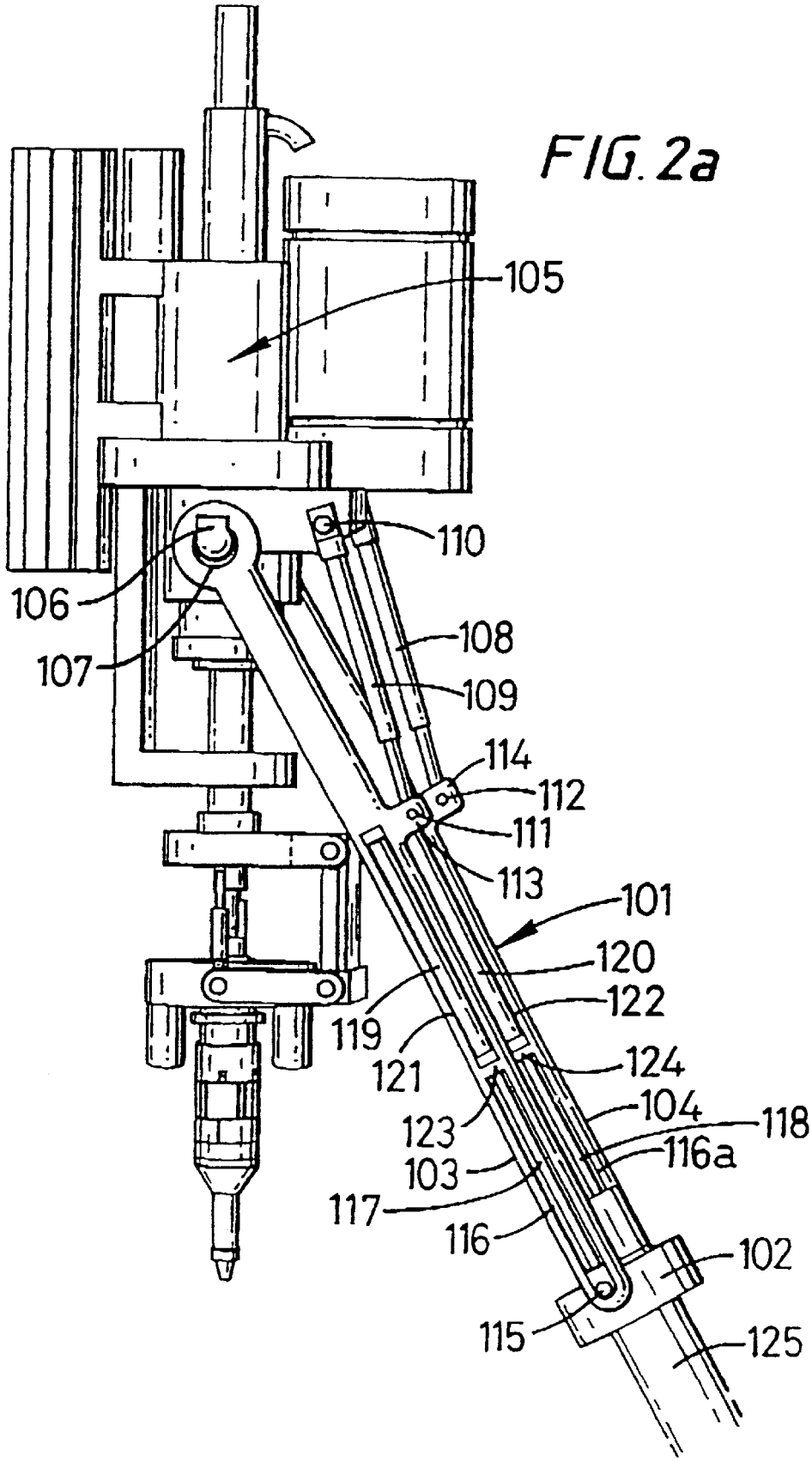
Figure 2B:
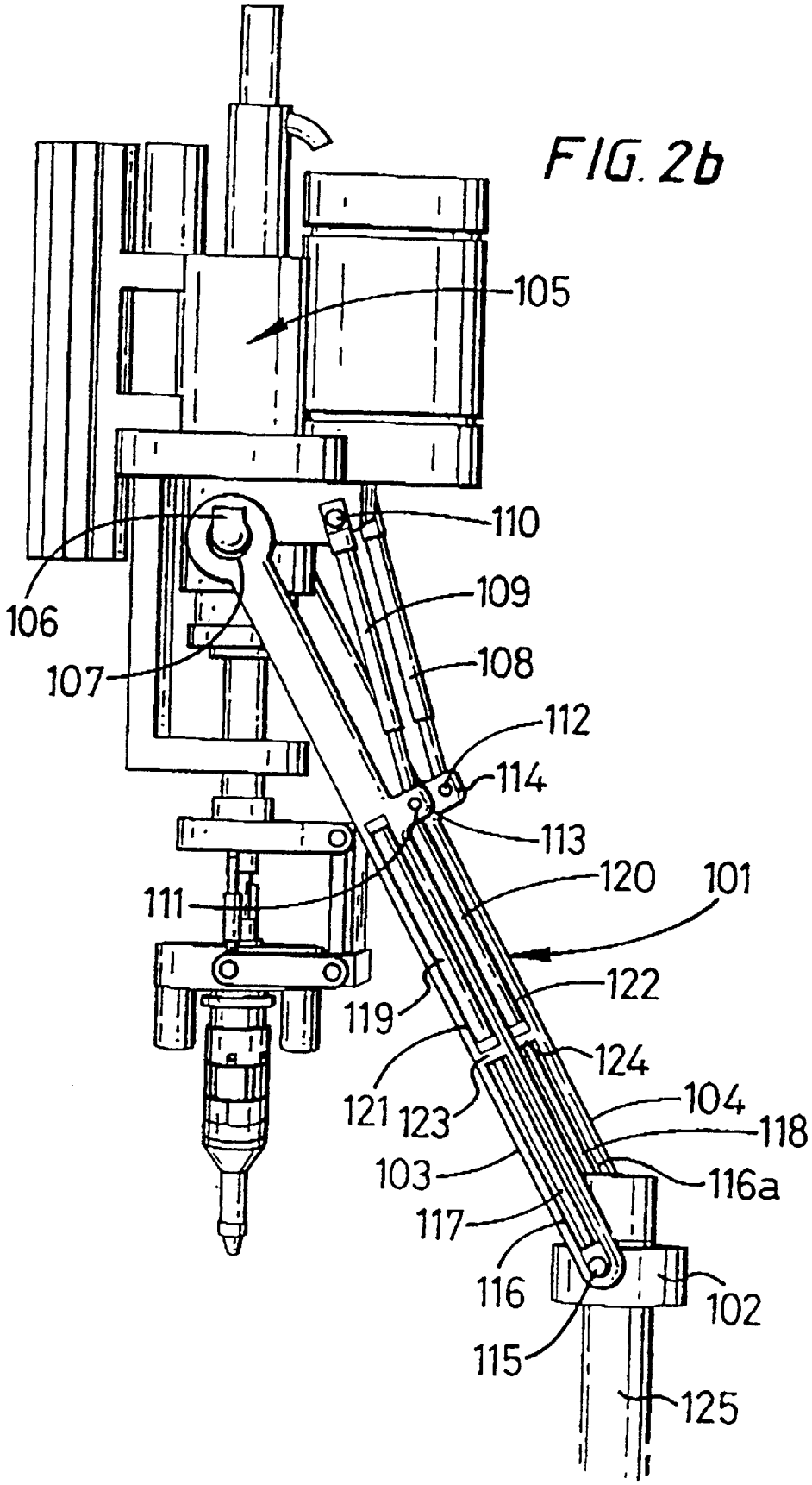
Figure 2C:
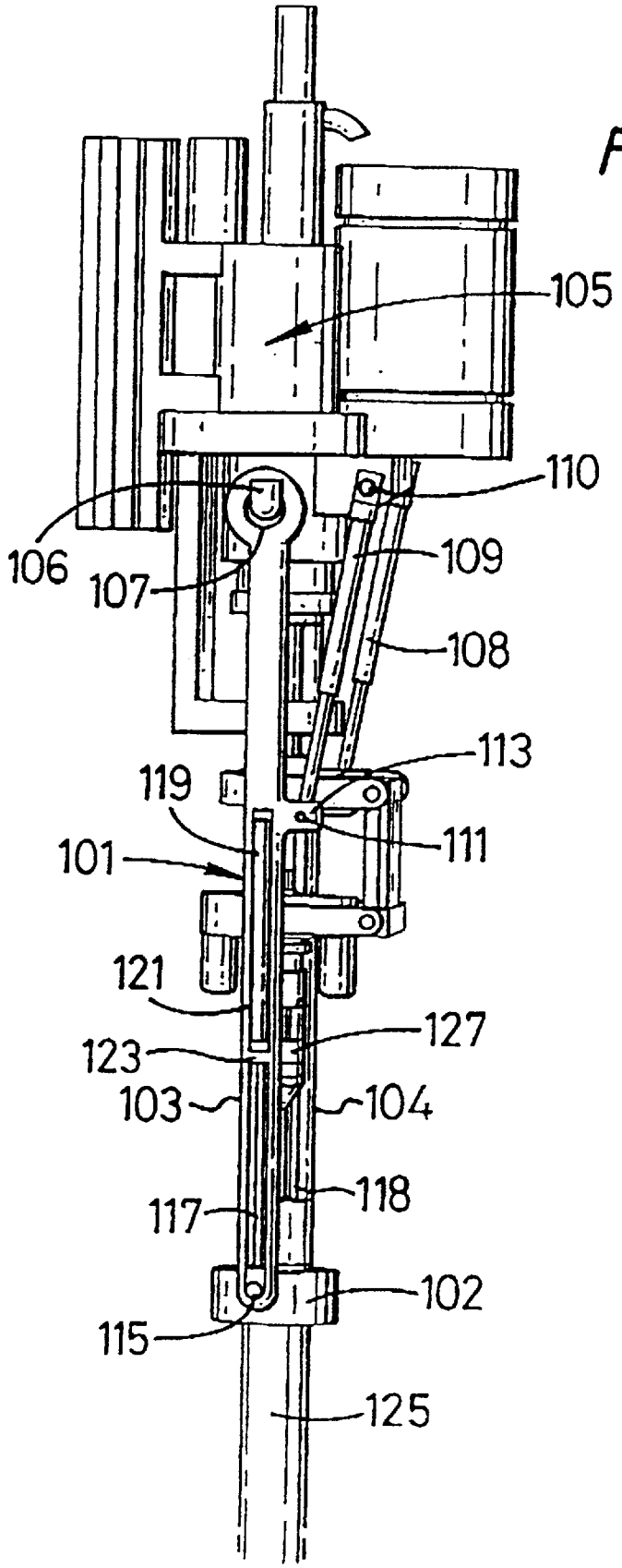
Figure 2D:
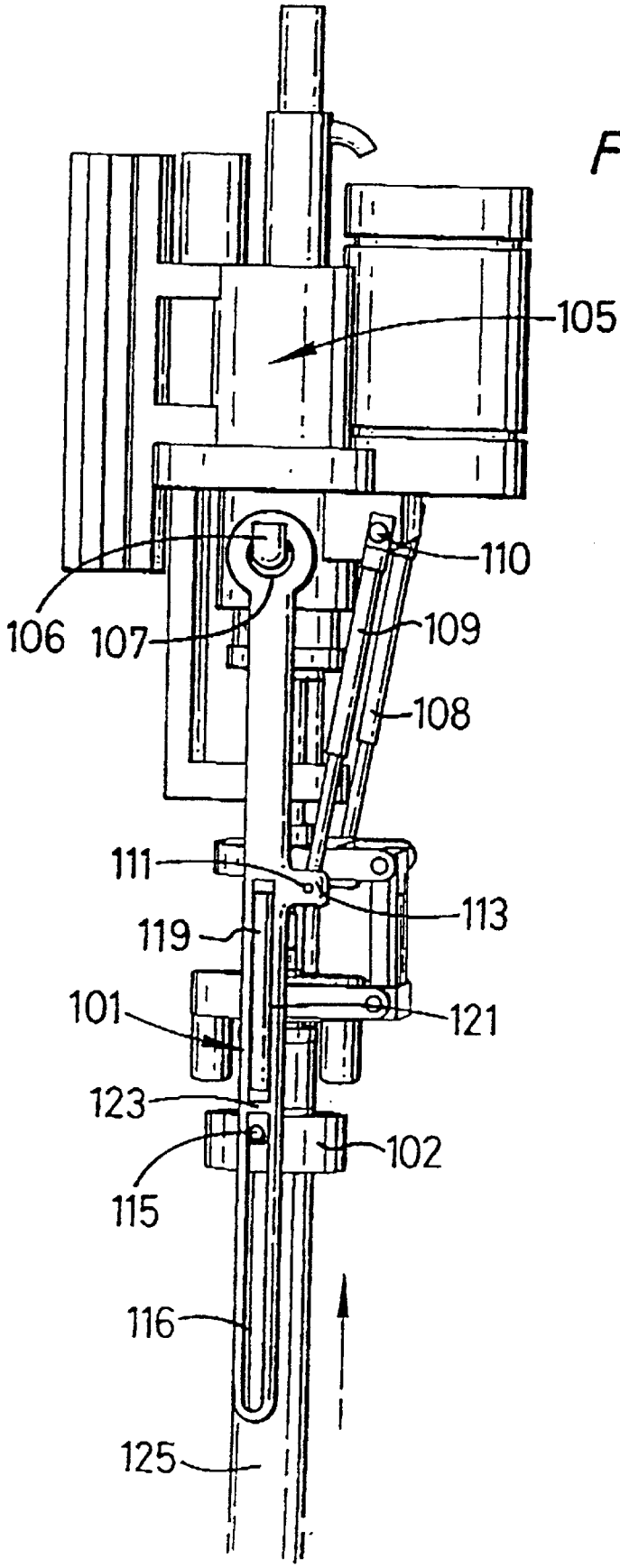

In use, a tubular 125 is angled from a rack near to the well centre. The tubular may however remain upright in the rack. The clamp 102 is placed around the tubular below a box 126 (FIG. 2*a*). The top drive is raised on a track on a derrick. The tubular is lifted from the rack and the tubular swings to hang vertically (FIG. 2*b*). The piston and cylinders 108, 109 are actuated, extending the pistons allowing the bails 103, 104 to move to a vertical position. The tubular 125 is now directly beneath a tool 127 for internally gripping and rotating the tubular 125 (FIG. 2*c*). The pistons 117, 118 and cylinders 119, 120 are now actuated. The pins 115 follow slot 116 and the clamp 102 moves upwardly, lifting the tubular 125 over the tool 127 (FIG. 2*d*). The tool 127 can now be actuated to grip the tubular 125.

At this stage the elevator 102 is released and the top drive 105 lowered to enable the tubular 125 to be connected to the string of tubulars in the slips and torqued appropriately by the top drive 105.

The pistons 117, 118 and cylinders 119, 120 are meantime extended so that after the tubular 125 has been connected the top drive 105 can be raised until the elevator 102 is immediately below the box. The elevator 102 is then actuated to grip the tubular 125 firmly. The top drive 105 is then raised to lift the tubular string sufficiently to enable the wedges in the slips to be withdrawn. The top drive 105 is then lower to the drilling platform, the slips applied, the elevator 102 raised for the tubular 125 and the process repeated.

I claim:

1. An apparatus for facilitating the connection of tubulars using a top drive and comprising:

a suspension unit (9) for coupling a tubular (3) to the top drive, the suspension unit (9) having a static part fixed with respect to a top drive and a dynamic part movable relative thereto; and a winch (15) located on said static part of said suspension unit (9), at least one wire (4, 5), and a device (2) for gripping the tubular (3), the arrangement being such that, in use, the winch (15) can be used to winch said at least one wire (4, 5) and said device (2) to position the tubular (3) below said top drive.

2. An apparatus as claimed in claim 1, comprising a guide (7) located on said dynamic part (8) of said suspension unit (9).

3. An apparatus as claimed in claim 2, comprising a pulley wheel (11) on said static part of said suspension unit (9).

4. A method of facilitating the connection of tubulars using a top drive having a suspension unit (9) for coupling a tubular (3) to the top drive, the suspension unit (9) having a static part fixed with respect to a top drive and a dynamic part movable relative thereto, the static part defining a winch, the method comprising the steps of attaching at least one wire to a tubular, the wire depending from the static part of said suspension unit, and winching the wire and the tubular upwards to a position beneath the top drive.

5. An apparatus for facilitating the connection of tubulars using a top drive, said apparatus comprising:

an elevator, and a pair of bails, wherein said elevator is movable along said pair of bails.

6. An apparatus as claimed in claim 5, further comprising a piston (117, 118) and cylinder (119, 120) operatively connected between said pair of bails (103, 104) and said elevator (102).

7. An apparatus as claimed in claim 6, wherein said piston (117, 118) and cylinder (119, 120) are pneumatically or hydraulically operable.

8. An apparatus for facilitating the connection of tubulars using a top drive, said apparatus comprising:

an elevator (102) having pins (115); and a pair of bails (103, 104) comprising slots (116, 116*a*) in which said pins (115) are disposed, wherein said elevator (102) is movable along said pair of bails (103, 104).

9. An apparatus for facilitating the connection of tubulars using a top drive, said apparatus comprising:

an elevator (102); and a pair of bails (103, 104) attached to an axle (106) disposed on the top drive and are movable thereabout, wherein said elevator (102) is movable along said pair of bails (103, 104).

10. An apparatus for facilitating the connection of tubulars using a top drive, said apparatus comprising:

an elevator (102);

a pair of bails (103, 104) attached to an axle (106) disposed on the top drive and are movable thereabout, wherein said elevator (102) is movable along said pair of bails (103, 104); and at least one piston and cylinder (108, 109) for moving said pair of bails (103, 104).

11. A method for facilitating the connection of tubulars using a top drive, said method comprising:

using an elevator to move a tubular to a position below said top drive, wherein the elevator is connected to the top drive using a pair of bails and wherein the elevator is movable along said pair of bails.

12. A method of claim 11, wherein the elevator moves said tabular towards or away from a tool for gripping said tubular.

13. A method for connecting a first tubular and a second tubular using a top drive, comprising:

gripping the first tubular with a clamp;

raising the first tubular toward a tool;

holding the first tubular with the tool;

connecting the first tubular to the second tubular;

releasing the first tubular from the clamp and the tool;

gripping the first tubular with an elevator; and lower the first tubular.

14. The method of claim 13, wherein the second tubular is held by a spider.

15. The method of claim 13, wherein connecting the first tubular to the second tubular comprises rotating the first tubular relative to the second tubular.

16. The method of claim 13, wherein the clamp and the elevator are both connected to the top drive.

17. The method of claim 16, wherein the clamp is connected to the top drive using at least one wire.

18. The method of claim 16, wherein the elevator is connected to the top drive using at least one bail.

* * * * *